US011864580B2

(12) United States Patent
Baldanza et al.

(10) Patent No.: US 11,864,580 B2
(45) Date of Patent: Jan. 9, 2024

(54) METHOD AND UNIT FOR CRIMPING A WEB OF MATERIAL FOR THE TOBACCO INDUSTRY

(71) Applicant: G.D S.P.A., Bologna (IT)

(72) Inventors: Nicola Baldanza, Zola Predosa (IT); Massimo Sartoni, Bologna (IT); Luca Federici, Bologna (IT)

(73) Assignee: G.D S.P.A., Bologna (IT)

( * ) Notice: Subject to any disclaimer, the term of this patent is extended or adjusted under 35 U.S.C. 154(b) by 85 days.

(21) Appl. No.: 16/954,439

(22) PCT Filed: Dec. 17, 2018

(86) PCT No.: PCT/IB2018/060188
§ 371 (c)(1),
(2) Date: Jun. 16, 2020

(87) PCT Pub. No.: WO2019/123210
PCT Pub. Date: Jun. 27, 2019

(65) Prior Publication Data

US 2021/0084966 A1 Mar. 25, 2021

(30) Foreign Application Priority Data

Dec. 22, 2017 (IT) ..... 102017000148879

(51) Int. Cl.
*A24B 3/14* (2006.01)
*A24D 3/02* (2006.01)
*A24C 5/00* (2020.01)

(52) U.S. Cl.
CPC ..... *A24B 3/14* (2013.01); *A24C 5/005* (2013.01); *A24D 3/0204* (2013.01)

(58) Field of Classification Search
CPC ..... A24B 15/16; A24B 3/14; A24B 13/00; A24B 15/14; A24B 3/18; A24B 15/12;
(Continued)

(56) References Cited

U.S. PATENT DOCUMENTS 4,030,511 A * 6/1977 Wahle ..... A24C 5/31 131/94
4,047,536 A 9/1977 Asfour
(Continued)

FOREIGN PATENT DOCUMENTS

CN 105687167 A 6/2016
CN 106998785 A 8/2017
(Continued)

OTHER PUBLICATIONS

Nakatsugawa M, JP-2013123733-A, "Controller and Control Method for Pinch Roll Gap", Jun. 2013, Machine translation. (Year: 2013).*
(Continued)

*Primary Examiner* — Kelly M Gambetta
*Assistant Examiner* — Stephanie Lynn Moore
(74) *Attorney, Agent, or Firm* — SHUTTLEWORTH & INGERSOLL, PLC; Timothy J. Klima

(57) ABSTRACT

This invention relates to a method for crimping a web of material for the tobacco industry, including the following steps:

feeding a web of material for the tobacco industry along a feed path;

crimping the web between two crimping rollers operatively coupled to make a plurality of longitudinal easy folding lines on the web;

measuring a value of a thickness of the web before the step of crimping;

The step of crimping the web is adjusted as a function of the thickness value measured during the step of measuring.

18 Claims, 2 Drawing Sheets

(58) Field of Classification Search
CPC ..... A24B 15/18; A24B 3/04; A24C 5/1828; A24C 5/005; A24C 5/01; A24C 5/00; A24C 5/18; A24C 5/28; A24C 5/34; A24D 3/0204; A24D 3/0233
See application file for complete search history.

(56) References Cited

U.S. PATENT DOCUMENTS

| | | | | |
|---|---|---|---|---|
| 5,085,229 | A * | 2/1992 | Tallier | A24C 5/1871 131/906 |
| 9,151,595 | B1 * | 10/2015 | Cook | G01B 11/06 |
| 2004/0122547 | A1 * | 6/2004 | Seymour | A24C 5/005 700/110 |
| 2017/0303579 | A1 * | 10/2017 | Soo | A24B 3/14 |

FOREIGN PATENT DOCUMENTS

| | | | |
|---|---|---|---|
| DE | 4344621 | A1 | 6/1995 |
| DE | 102005002351 | A1 | 7/2006 |
| DE | 102009027430 | A1 | 1/2011 |
| DE | 102015010563 | A1 | 2/2017 |
| EP | 0511488 | A1 | 11/1992 |
| EP | 2666624 | A1 | 11/2013 |
| JP | 2017501686 | | 1/2017 |
| JP | 2017501686 | A | 1/2017 |
| WO | 2015097127 | A1 | 7/2015 |
| WO | 2016023965 | A1 | 2/2016 |

OTHER PUBLICATIONS

International Search Report dated Mar. 25, 2019 from counterpart PCT App No. PCT/IB2018/060188.
Chinese Office Action dated Sep. 10, 2021 from counterpart Chinese Patent Application No. 201880082380.4.
Notice of Opposition dated Aug. 3, 2023 from Application No. 18836888.0—Patent No. EP3727042 [Machine Translation].
Folding in Practice, Heidelberger Druckmaschinen GmbH, Press Release Jun. 2004 [Machine Translation].

* cited by examiner

METHOD AND UNIT FOR CRIMPING A WEB OF MATERIAL FOR THE TOBACCO INDUSTRY

This application is the National Phase of International Application PCT/IB2018/060188 filed Dec. 17, 2018 which designated the U.S.

This application claims priority to Italian Patent Application No. 102017000148879 filed Dec. 22, 2017, which application is incorporated by reference herein.

TECHNICAL FIELD

This invention relates to a method and a unit for crimping a web of material for the tobacco industry.

BACKGROUND ART

The term "crimp" is used generally to mean making a plurality of longitudinal easy folding lines on a web, preferably continuous, sliding between two rollers which are configured to modify the transverse cross section of the web.

The web obtained by crimping has a corrugated or zigzag transverse cross section, where the longitudinal crests are defined by the easy folding lines impressed by the crimping rollers.

In particular, the crimping treatment which the continuous web undergoes allows the web to be used in the tobacco industry to make traditional filter cigarettes, that is, cigarettes which can be smoked by burning the end of the cigarette opposite the filter, or electronic cigarettes such as, for example: heat not burn, electronic-cig, mixed electronic-cig and tobacco.

The webs intended for crimping may be variable in thickness.

The Applicant has found that the variability of the thickness may be due to any of a number of factors, including the use of different webs or non-uniformity of the web itself.

Crimping processes are therefore not always performed in the best manner because the crimping station, which is initially set on the basis of a reference thickness value, is subjected to variations in web thickness which can cause damage to it or lead to incorrect crimping of the web.

In effect, if the web is too thin, crimping is relatively ineffective because the folds made have an insufficient effect on the web. Indeed, if the web passing between the crimping rollers is too thin relative to the distance between the rollers, the rollers are unable to apply an adequate crimping action with the risk of incorrectly deforming/folding the web.

On the contrary, if the web is too thick, the crimping action might lead to jamming, or even severing, of the web.

As a result, a crimping operation performed on even just one portion of web whose thickness does not conform with the specific setting of the crimping rollers may lead to the production of a defective end product which must be rejected. There is also the risk of having to interrupt production on account of jams in the crimping unit.

In machines for the tobacco industry, it is known that the web is unwound from rolls. When the web from one roll is finished, it must be spliced to the web from another roll.

The webs from different rolls are not always the same, however, and in particular, may differ in thickness.

In many cases, for example, the rolls are from different batches or different suppliers and the web on each new roll may differ in thickness from the one preceding it and may be unsuitable for the crimp settings of the crimping station at a particular moment.

DISCLOSURE OF THE INVENTION

In this context, the technical purpose which forms the basis of this invention is to propose a method and a unit for crimping a web of material for the tobacco industry to overcome one or more of the above mentioned drawbacks of the prior art.

More specifically, the aim of this invention is to provide a method for crimping a web of material for the tobacco industry which allows improving the efficiency of the production process and the quality of the finished product.

A further aim of this invention is to propose a unit for crimping a web of material for the tobacco industry which allows crimping to be carried out effectively and which is capable of adapting to the thickness of the web being fed.

The technical purpose indicated and the aims specified are substantially achieved by a method and a unit for crimping a web of material for the tobacco industry comprising the technical features described in one or more of the appended claims.

In particular, this invention provides a method for crimping a web of material for the tobacco industry comprising the steps of feeding a web of material for the tobacco industry along a feed path and crimping the web between two crimping rollers which are operatively coupled to make a plurality of longitudinal easy folding lines on the web.

Advantageously, the method also comprises a step of measuring a value of a thickness of the web before the step of crimping so that the step of crimping can be adjusted as a function of the thickness value measured during the step of measuring.

Thanks to this method, therefore, it is possible to automatically adjust the step of crimping based on the thickness value measured previously so as to achieve an effective crimping process which allows making a good quality crimped web.

In one embodiment of the invention, the method also comprises the step of comparing the measured value of the thickness of the web with a range of reference values. In this case, the step of crimping the web is adjusted if the measured value of the thickness of the web is outside the range of reference values.

It should be noted that the expression "range of values" is used herein to mean at least one reference value.

Advantageously, comparing the measured value with the range of reference values allows optimally ensuring that criteria of acceptability are met in order for crimping to be carried out correctly, thereby overcoming the above mentioned drawbacks.

The invention also provides a unit for crimping a web of material for the tobacco industry, comprising a crimping station equipped with a first crimping roller and a second crimping roller operatively coupled to make a plurality of longitudinal easy folding lines on the web in transit between the crimping rollers.

Advantageously, the unit also comprises:

- at least one sensor configured to measure a value of a thickness of the web and disposed upstream of the crimping station;
- adjustment means acting on the crimping station to vary the operating parameters of the crimping station;
- a control and drive unit connected to the at least one sensor and acting on the adjustment means to vary one or more of the operating parameters of the crimping station as a function of the value of the thickness measured by the at least one sensor.

Thanks to the sensors which are capable of measuring the thickness of the web, it is thus possible to adjust the crimping station in such a way that it adapts to the thickness of the web, if necessary.

Thanks to the presence of a control and drive unit connected to the adjustment means, it is possible to trigger an adjustment of the crimping station when the variation in the thickness of the web does not fall within the predetermined criteria of acceptability, so that the crimping action on the web is always effective and allows a good quality crimped web to be made at all times, reducing the risk of jamming and production rejects.

In an embodiment, the control and drive unit is therefore configured to compare the measured value of the thickness of the web with a range of reference values so that crimping station is adjusted if the measured value of the thickness of the web is outside the range of reference values. In other terms, in this case, the control and drive unit is provided with a storage medium in which the range of reference values is stored.

The unit of this invention enables production times and costs to be optimized because adjustment of the crimping station does not necessitate interrupting the production cycle to vary the operating parameters through the manual intervention of an operator.

The dependent claims, which are incorporated herein by reference, correspond to different embodiments of the invention.

BRIEF DESCRIPTION OF THE DRAWINGS

Further features and advantages of this invention are more apparent in the description below, with reference to a preferred, non-limiting embodiment of a unit for crimping a web of material for the tobacco industry as illustrated in the accompanying drawings, in which.

DETAILED DESCRIPTION OF PREFERRED EMBODIMENTS OF THE INVENTION

Figure 1:
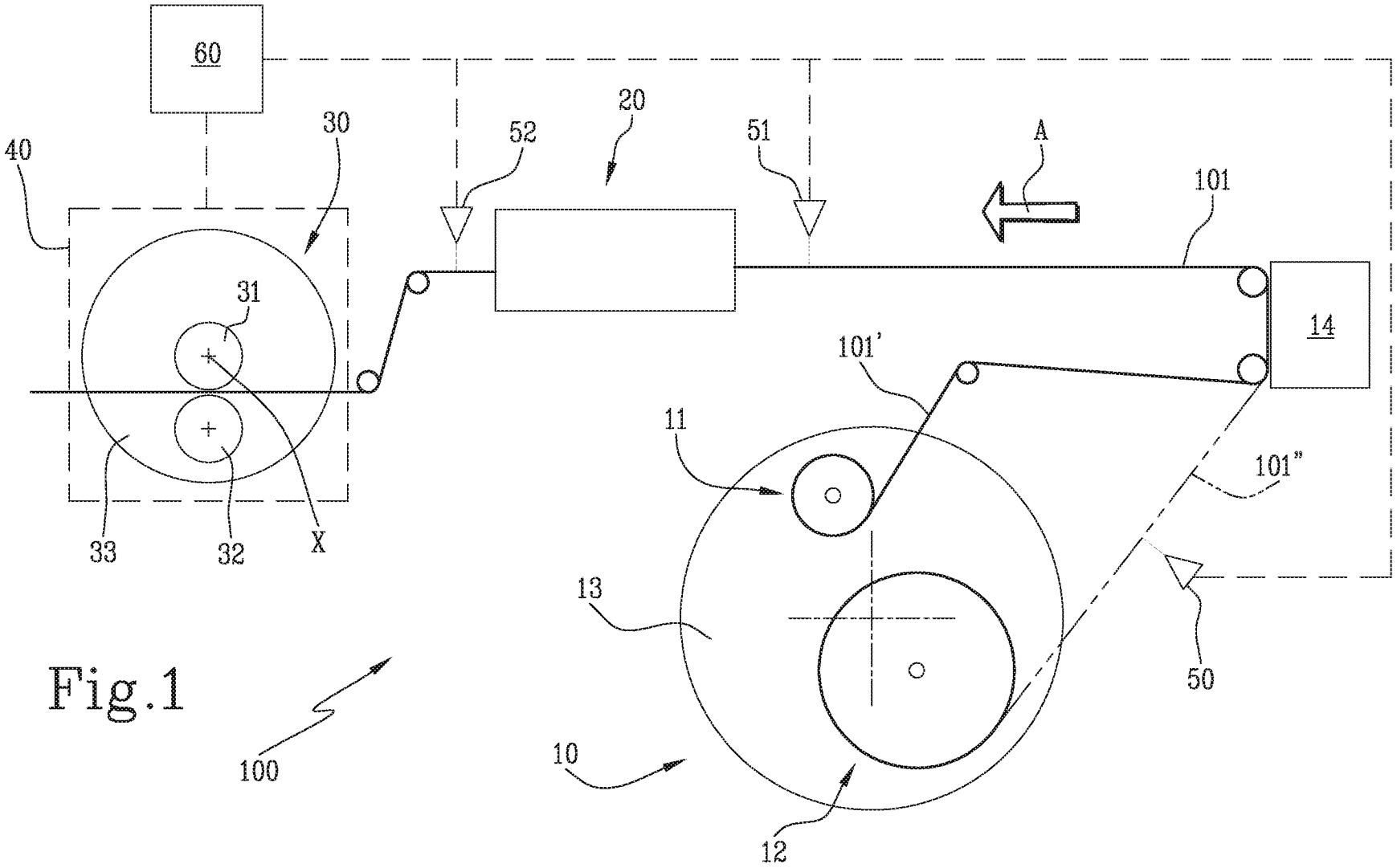
FIG. 1 shows a function diagram of a unit for crimping a web of material for the tobacco industry according to this invention.

With reference to the accompanying drawings, the numeral 100 denotes in its entirety a unit for crimping a web of material for the tobacco industry, hereinafter referred to simply as unit 100.

Preferably, the unit 100 comprises a feed station 10 for feeding a web 101 of material for the tobacco industry.

According to this invention, the material for the tobacco industry may be, for example, tobacco based material (reconstituted, pre-treated, homogenized or cast-leaf tobacco), filter paper material or PLA.

Preferably, the feed station 10 has at least two rolls 11, 12: a first roll 11 is operational and a second roll 12 is on standby and vice versa, alternately. In other words, alternately, when the first roll 11 is being unwound, the second roll 12 remains idle and when one roll is finished, the web 101 is fed from the other roll so as to guarantee continuity. The roll that is finished is then replaced with a new one.

More specifically, the two rolls 11, 12 are preferably mounted on a rotary turret 13 and, when unwinding from the first roll 11 stops, the turret rotates to allow feed to continue from the second roll 12.

Unwinding from the second roll is made possible by splicing the terminal end of a first web 101' of the first roll 11 to the initial end of a second web 101" of the second roll 12 at a welding station 14 so that the web 101 is uninterrupted.

With reference to FIG. 1 in particular, the web 101 is adapted to be unwound along a longitudinal feed direction, indicated by the arrow "A".

Preferably, the web 101', 101" unwound from the rolls 11, 12 is not crimped.

Along the feed path "A", the unit 100 preferably comprises one or more systems for adjusting the tension of the web 101 (for example, dancer rollers and/or one or more systems for centring the web 101), not illustrated in the accompanying drawings.

The unit 100 preferably also comprises a reservoir 20 configured to store part of the web 101 being fed along the path "A". In other words, the reservoir 20 has the function of creating a dynamic buffer which can be used in various different situations to prevent interrupting the production cycle, as will become clearer as this description continues.

Still more preferably, the reservoir 20 comprises a plurality of idler rollers, not illustrated in the accompanying drawings, which guide the web 101 along a substantially "up-and-down" path.

The unit 100 then comprises a crimping station 30 equipped with a first crimping roller 31 and a second crimping roller 32 operatively coupled and configured to make a plurality of longitudinal easy folding lines (not illustrated) on the web 101 in transit between the crimping rollers 31, 32.

In a possible embodiment of this invention, not illustrated in the accompanying drawings, the crimping station 30 may also be configured, and equipped with suitable cutting means, to make a plurality of longitudinal cutting lines alternated with the longitudinal easy folding lines; or the unit 100 may comprise a station for treating the web 101, located upstream or downstream of the crimping station 30 and configured to make the longitudinal cutting lines before or after the step of crimping.

Preferably, the crimping rollers 31, 32 have a wavy profile, with respective protrusions and recesses, configured to condition the material of the web 101 in such a way as to make easy folding lines at each interface between protrusion and recess of the two crimping rollers 31, 32.

Advantageously, the unit 100 comprises adjustment means 40 acting on the crimping station 30 to vary the operating parameters of the crimping station 30.

The operating parameters may be, for example, the distance between the crimping rollers 31, 32 or their position relative to the feed direction of the web 101 or the winding angle of the web 101 being fed between the two crimping rollers 31, 32.

Preferably, at least one of the two crimping rollers 31, 32 is adjustably mounted relative to the other crimping roller 31, 32 to vary the mutual distance between them and the adjustment means 40 act on at least one of the two crimping rollers 31, 32 to vary the mutual distance between the crimping rollers 31, 32. Preferably also, in addition or alternatively, at least one of the two crimping rollers 31, 32 is adjustably mounted relative to the other crimping roller 31, 32 to vary a mutual position between the crimping rollers 31, 32, in such a way as to vary the geometry of the feed path "A" of the web 101 at the two crimping rollers 31, 32, and the adjustment means 40 act on at least one of the two crimping rollers 31, 32 to vary their mutual position.

Figure 2:
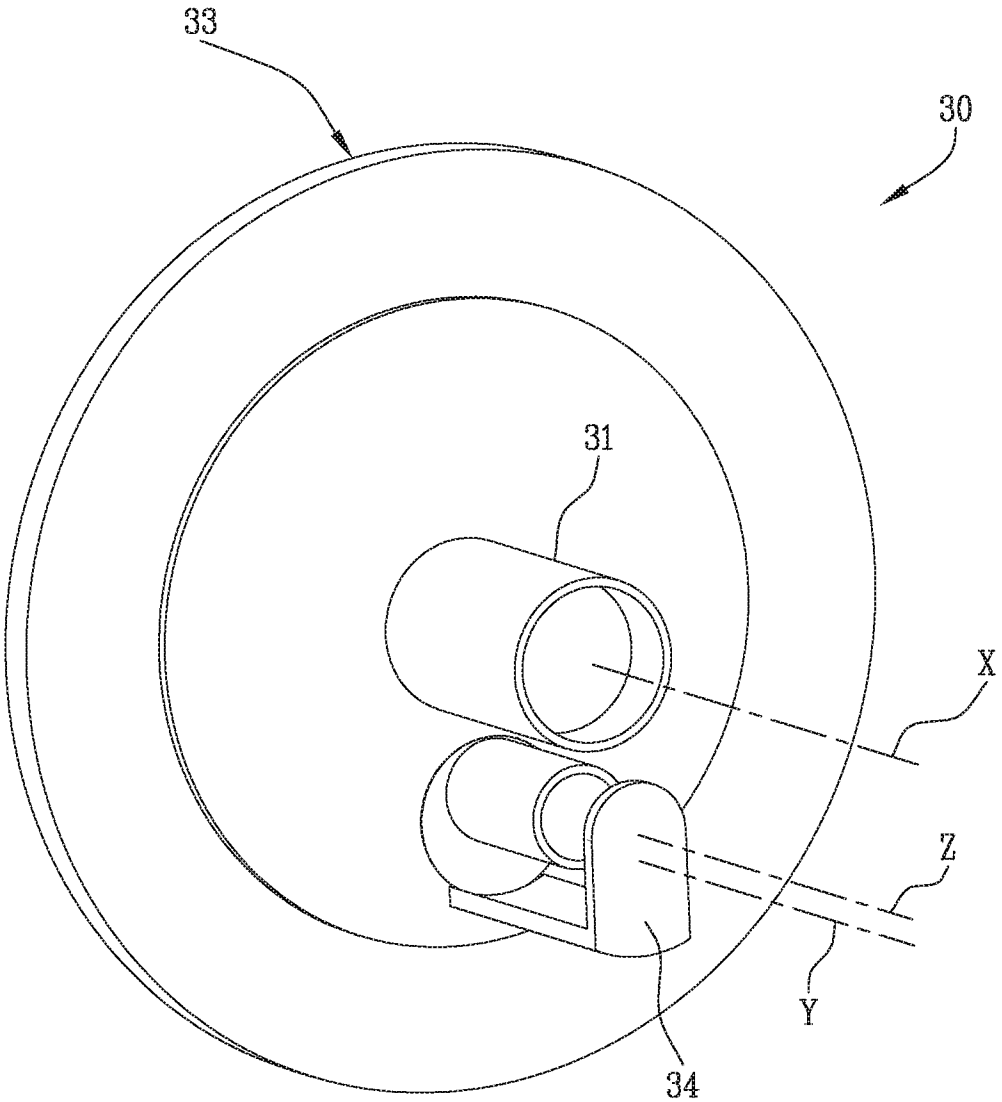
FIG. 2 is a schematic perspective view of a crimping station according to this invention, with some parts cut away in order to better illustrate others.

With reference to FIG. 2, the crimping station 30 preferably comprises a supporting element 33 which the two crimping rollers 31, 32 are mounted on.

Advantageously, the supporting element 33 is configured to adopt variable position and/or orientation in such a way as to vary the orientation of the web 101 being fed to the crimping rollers 31, 32 relative to the crimping rollers 31, 32 themselves.

Advantageously, the adjustment means 40 act on the supporting element 33 to vary the position and/or the orientation of the supporting element 30.

Preferably, the supporting element 33 is rotatable about an adjustment axis "X" and the first crimping roller 31 is coaxial with the adjustment axis "X".

Also preferably, the second crimping roller 32 is eccentric relative to the adjustment axis "X" of the supporting element 33 and, still more preferably, it is mounted on the supporting element 33 by means of a roller holder 34 whose axis of rotation "Y" is eccentric relative to a respective axis of rotation "Z" of the second crimping roller 32.

It should be noted that the second crimping roller 32 is not shown in FIG. 2 in order to better illustrate the operation of the eccentric.

The roller holder 34 is thus configured to rotate about the axis of rotation "Y" and the second crimping roller 32 is mounted on the roller holder 34 rotatably about the axis of rotation "Z".

That way, the rotation of the roller holder 34 about its axis of rotation "Y" causes displacement of the axis of rotation "Z" of the second crimping roller 32 and hence, displacement of the crimping rollers 31, 32 relative to each other.

Advantageously, the adjustment means 40 act on the roller holder 34 and/or on the supporting element 33.

To perform the adjustment, the supporting element 33 comprises motor means, not illustrated, acting on the supporting element 33 to vary the position and/or orientation of the supporting element 33 and/or of the crimping rollers 31, 32.

In other words, the supporting element 33 is movable in such a way as to be able to modify the arrangement of the crimping rollers 31, 32 associated therewith, by changing their arrangement within the crimping unit 100 so as to make the web 101 follow a different path defined by the specific arrangement adopted by the crimping rollers 31, 32 or by simply adjusting the distance between the two crimping rollers 31, 32 themselves.

In a preferred embodiment, the supporting element 33 is rotatable about the axis of adjustment "X" to allow turning the crimping station 30 in such a way as to modify, by increasing or decreasing, the winding angle of the web 101 on the first and/or the second crimping roller 31, 32.

Preferably, as illustrated in FIG. 2, the supporting element 33 is embodied by a vertical plate which is supported rotatably about the axis of adjustment "X".

Also in this preferred embodiment, the first crimping roller 31 is supported by the supporting element 33 and is connected thereto at its centre of rotation, while the second crimping roller 32 is supported by the supporting element 33 and connected thereto in a zone outside its centre of rotation.

In other words, the axis of rotation of the first crimping roller 31 is coaxial with the axis of adjustment "X" of the supporting element 33, while the axis of rotation "Z" of the second crimping roller 32 is eccentric (and parallel) relative to the axis of adjustment "X".

Advantageously, the reservoir 20 is preferably disposed between the feed station 10 and the crimping station 30 so that if the feed station 10 stops feeding the web 101 because the roll 11, 12 needs to be changed and then spliced, feed can continue uninterruptedly by using at least some of the web 101 stored in the reservoir 20 to supply the crimping station 30 until unwinding of the web 101 is resumed, now from the second roll 12.

Advantageously, the unit 100 also comprises:

at least one sensor 50, 51, 52 configured to measure a value of a thickness of the web 101, where the at least one sensor 50, 51, 52 being disposed upstream of the crimping station 30; and a control and drive unit 60 connected to the at least one sensor 50, 51, 52 and acting on the adjustment means 40 to vary one or more of the operating parameters of the crimping station 30 as a function of the value of the thickness measured by the at least one sensor 50, 51, 52.

Thanks to the presence of at least one sensor 50, 51, 52, which allows measuring the thickness of the web 101, and of the adjustment means 40, which allow adjusting the crimping station 30 as a function of the thickness of the web 101, it is possible to obtain a smart unit 100 capable of quickly adapting to the features of the web 101, thereby increasing the efficiency of the production process and guaranteeing effective crimping of the web 101 even if the thickness of the web 101 changes suddenly.

Preferably, the at least one sensor 50, 51, 52 is an optical sensor, and still more preferably, a reflective laser sensor.

In an embodiment, one or more of the operating parameters of the crimping station 30 are varied if the measured value of the thickness of the web 101 falls outside a range of reference values.

The range of reference values may comprise one or more reference values.

FIG. 1 shows some of the sensors 50, 51, 52 that may be provided in the unit 100.

More specifically, one sensor 52 is preferably located downstream of the reservoir 20 and is configured to continuously measure the thickness of the web 101 as the web 101 moves along the feed path "A".

More specifically, one sensor 51 is preferably located upstream of the reservoir 20 and is configured to measure the thickness of the web 101 in a portion of the web 101 in a measurement zone, preferably stationary, located upstream of the reservoir 20.

More specifically, one sensor 50 preferably acts on at least one of the two rolls 11, 12 and, still more preferably, the sensor 50 is a mechanical feeler.

The sensor 50 preferably measures the thickness of the second web 101" of the second, standby roll 12 before the second web 101" is unwound and spliced to the remaining portion of the first web 101'.

Preferably, the sensor 50 measures the thickness of the second web 101" at a portion of it which is stationary relative to the moving portion of web 101.

The unit 100 according to this invention thus allows measuring the thickness of the web 101 and issuing a command for adjusting the crimping station 30 so as to guarantee correct crimping in any situation.

For example, the control and drive unit 60 may activate the adjustment means 40 in such a way as to increase the distance between the two crimping rollers 31, 32 to allow the web 101 to move smoothly between them and to be crimped correctly. With reference to the embodiment described above, this operation may occur if the thickness measured is greater than the range of reference values (that is, than at least one reference value).

The control and drive unit 60 may also activate the adjustment means 40, for example, in such a way as to reduce the distance between the two crimping rollers 31, 32 to give the crimping rollers 31, 32 a better grip on the web 101, so as to crimp it more effectively.

According to a further aspect of it, this invention also provides a method for crimping a web 101 of material for the tobacco industry.

More specifically, in use, the unit 100 is capable of implementing the method according to this invention.

The method comprises the step of feeding the web 101 along the feed path "A" and crimping the web 101 between the two crimping rollers 31, 32.

Advantageously, the method also comprises a step of measuring a value of a thickness of the web 101 before the step of crimping. The step of crimping is adjusted on the basis of the measured value of the thickness of the web 101.

That way, the step of crimping the web 101 can be advantageously adjusted automatically based on the measured value of the thickness of the web 101.

Thanks to this method, it is thus possible to rapidly and effectively adapt crimping to the structure of the web 101 being fed, thereby preventing unsatisfactory crimping or jamming/blocking of the crimping station 30.

In an embodiment, the method also comprises a step of comparing the measured value of the thickness of the web 101 with a range of reference values. In this case, the step of crimping the web 101 is adjusted if the measured value of the thickness of the web 101 is outside the range of reference values (which, as mentioned above, comprises at least one reference value).

Preferably, the step of crimping the web 101 may be adjusted by a sub-step of adjusting a mutual distance between the two crimping rollers 31, 32 as a function of the thickness value measured in the step of measuring.

Thus, moving the crimping rollers 31, 32 further apart or closer together allows adapting the distance as a function of the measured thickness of the web 101.

Preferably, the step of crimping the web 101 may also, or alternatively, be adjusted by a sub-step of adjusting a mutual spatial position between the two crimping rollers 31, 32 to vary the geometry of the feed path of the web 101 at the two crimping rollers 31, 32, specifically to vary an angle of wrapping the web 101 on at least one of the two crimping rollers 31, 32.

That way, modifying the position of the rollers 31, 32 in the crimping station 30 allows modifying the geometry of the feed path "A" of the web 101 to facilitate crimping or achieve, so to speak a "pre-crimping" effect on one of the two rollers 31, 32 by increasing the angle of wrapping the web 101 on one of the two rollers 31, 32 before it moves between the two rollers 31, 32.

Preferably also, the step of measuring is carried out by measuring a plurality of thickness values on respective portions of the web 101 and the method comprising the step of calculating the average thickness value from the plurality of measured values.

In this case, the step of crimping the web 101 is adjusted as a function of an average thickness value obtained from the plurality of measured values.

In the embodiment described above, the step of comparing the measured value of the thickness of the web 101 with a range of reference values is carried out by comparing the average value with the range of reference values. That way, the step of crimping the web 101 is adjusted if the average thickness value obtained from the plurality of measured values is outside the range of reference values.

More specifically, the plurality of portions of the web 101 are measured in longitudinal and/or transverse sequence to obtain the average value of an area of web measured by the at least one sensor 50, 51, 52.

Advantageously, the average thickness value may also be obtained by processing an average of the thickness values measured in a certain measurement time interval.

Preferably, the step of measuring the value of the thickness of the web 101 is carried out using one or more optical sensors 50, 51, 52, preferably reflective laser sensors.

In a possible embodiment of the method according to this invention, the step of measuring is preferably carried out continuously while the web 101 is moving forward.

Thus, the trend of the thickness of the web 101 can be monitored continuously, by the sensor 52, for example, and issuing a command to adjust the crimping station 30, if necessary, if the measured thickness data do not meet predetermined criteria of acceptability.

In an alternative embodiment, the step of measuring the value of the thickness is, instead, preferably carried out in a measuring zone on a portion of web 101 while that portion is temporarily stationary, the measuring zone being disposed upstream of a storage zone of the web 101 where another portion of the web 101 is preferably in motion along the feed path "A", and the storage zone being disposed between the measuring zone and the two crimping rollers 31, 32.

That way, the thickness of the web 101 can be measured—for example using the sensor 51—on the stationary portion of web 101, whilst the portion of web 101 in the storage zone can continue to be fed to the crimping station 30 so as not to interrupt the production process.

Thus, use of the web 101 accumulated in the storage zone allows measurement to be performed on a portion of web 101 that is stationary, so that, for example, a roll 11, 12 can be changed in the feed station 10 without interrupting crimping downstream.

In this method, furthermore, the step of feeding the web 101 comprises the following sub-steps:

unwinding the first web 101' from the first roll 11, splicing the terminal portion of the first web 101' to an initial portion of the second web 101", unwinding the second web 101" from the second roll 12.

Advantageously, in this case, the step of measuring the thickness is carried out on the second web 101" by the sensor 50 for example, before starting to unwind the second web 101" from the second roll 12.

Still more preferably, the step of measuring the thickness of the web 101 is carried out using one or more mechanical feelers or optical sensors.

This invention thus allows the thickness of the web to be crimped to be measured before the step of crimping so that the crimping station can, if necessary, be adjusted by modifying the distance between the crimping rollers, or their position, as a function of the thickness measured, thus overcoming the drawbacks of the prior art.

In a possible alternative embodiment of this invention, it is also advantageously possible to measure the value of the thickness of the web to also adjust a step of forming a rod (for example by varying the position of the forming means) where the rod comprises the crimped web obtained by the step of crimping and/or to adjust a step of tensioning carried out by web tensioning dancer rollers (by varying their mutual position) upstream and/or downstream of the crimping station 30, as a function of the thickness value measured.

Advantageously, this invention allows obtaining a good quality web with longitudinal easy folding lines (if necessary, in combination with cutting lines, as mentioned above)

which can be easily folded to make, for example, rod-shaped smoking articles which are compact, uniform and firmly cohesive.

The invention claimed is:

1. A method for crimping a web of material for the tobacco industry, comprising the following steps:

feeding a web of material for the tobacco industry along a feed path;

crimping the web between two crimping rollers operatively coupled to make a plurality of longitudinal easy folding lines on the web;

measuring with at least one sensor a value of a thickness of the web before the step of crimping;

wherein the step of crimping the web is adjusted during crimping as a function of variations of the measured value of the thickness along the web measured with the at least one sensor; and wherein the two crimping rollers are mounted on a supporting element and wherein the method comprises varying at least one chosen from a position and an orientation of the supporting element to vary an orientation of the web being fed to the two crimping rollers relative to the two crimping rollers.

2. The method according to claim 1, further comprising comparing the measured value of the thickness of the web with a range of reference values; wherein the step of crimping the web is adjusted if the measured value of the thickness of the web is outside the range of reference values.

3. The method according to claim 1, wherein the step of crimping the web is adjusted by a sub-step of adjusting a mutual distance between the two crimping rollers as a function of the thickness value measured in the step of measuring.

4. The method according to claim 1, wherein the step of crimping the web is adjusted by a sub-step of adjusting a mutual spatial position between the two crimping rollers to vary a geometry of the feed path of the web at the two crimping rollers, to vary an angle of wrapping the web on at least one of the two crimping rollers.

5. The method according to claim 1, wherein the step of measuring the thickness is carried out by measuring a plurality of thickness values on respective portions of the web; the method further comprising calculating an average thickness value from the plurality of measured values, and wherein the step of crimping the web is adjusted as a function of an average thickness value obtained from the plurality of measured values.

6. The method according to claim 1, wherein the at least one sensor is at least one laser sensor.

7. The method according to claim 1, wherein the step of measuring the value of the thickness of the web is carried out continuously while the web is moving forward.

8. The method according to claim 1, wherein the step of measuring the value of the thickness of the web is carried out in a measuring zone on a portion of the web while the portion of the web is temporarily stationary, the measuring zone being disposed upstream of a storage zone of the web, where another portion of the web is in motion along the feed path, the storage zone being disposed between the measuring zone and the two crimping rollers.

9. The method according to claim 1, wherein the step of feeding the web comprises the following sub-steps:

unwinding a first web from a first roll, splicing a terminal portion of the first web to an initial portion of a second web forming part of a second roll, unwinding the second web from the second roll, wherein the step of measuring the value of the thickness of the web is carried out on the second web before starting to unwind the second web from the second roll.

10. The method according to claim 9, wherein the at least one sensor is an optical sensor or a mechanical feeler.

11. A unit for crimping a web of material for the tobacco industry, comprising:

a crimping station including a first crimping roller and a second crimping roller operatively coupled to make a plurality of longitudinal easy folding lines on the web in transit between the crimping rollers;

at least one sensor configured to measure, during crimping, a value of a thickness of the web, the at least one sensor being disposed upstream of the crimping station;

an adjustment mechanism acting on the crimping station to vary operating parameters of the crimping station;

a control and drive unit connected to the at least one sensor and acting on the adjustment mechanism to vary, during crimping, one or more of the operating parameters of the crimping station as a function of variations of the value of the thickness along the web measured by the at least one sensor;

wherein the crimping station comprises a supporting element mounting the first and second crimping rollers, and wherein the supporting element is configured to adopt at least one chosen from a variable position and a variable orientation to vary an orientation of the web being fed to the first and second crimping rollers, relative to the first and second crimping rollers, the adjustment mechanism acting on the supporting element to vary at least one chosen from the position and the orientation of the supporting element.

12. The crimping unit according to claim 11, wherein the control and drive unit acts on the adjustment mechanism to vary one or more of the operating parameters of the crimping station if the measured value of the thickness of the web falls outside a range of reference values.

13. The crimping unit according to claim 11, wherein at least one of the first and second crimping rollers is adjustably mounted relative to the other of the first and second crimping rollers to vary a mutual distance between the first and second crimping rollers, wherein the adjustment mechanism acts on the at least one of the first and second crimping rollers to vary the mutual distance between the first and second crimping rollers.

14. The crimping unit according to claim 11, wherein at least one of the first and second crimping rollers is adjustably mounted relative to the other of the first and second crimping rollers to vary a mutual position between the first and second crimping rollers, to vary a geometry of the feed path of the web at the first and second crimping rollers, and wherein the adjustment mechanism acts on the at least one of the first and second crimping rollers to vary the mutual position between the first and second crimping rollers.

15. The crimping unit according to claim 11, wherein:

the supporting element is rotatable about an adjustment axis, the first crimping roller is coaxial with the adjustment axis of the supporting element, a roller holder mounted to the supporting element and having an axis of rotation eccentric relative to a respective axis of rotation of the second crimping roller;

the second crimping roller being mounted on the roller holder to be eccentric relative to the adjustment axis of the supporting element; and wherein the adjustment mechanism acts on the roller holder and/or on the supporting element.

16. The crimping unit according to claim 11, wherein the at least one sensor is a reflective laser sensor.

17. The crimping unit according to claim 11, comprising a reservoir for the web, disposed along the feed path between the crimping station and the at least one sensor, the at least one sensor being disposed upstream of the reservoir and being configured to measure the thickness of the web in a measuring zone on a portion of web, which is stationary and disposed upstream of the reservoir.

18. The crimping unit according to claim 11, comprising a feed station having at least two rolls, wherein a first roll of the two rolls is operational and a second roll of the two rolls is on standby and vice versa, alternately, and wherein the at least one sensor acts on at least one of the two rolls, the sensor being a mechanical feeler or an optical sensor.

* * * * *